US007522135B2

(12) United States Patent
Baik

(10) Patent No.: US 7,522,135 B2
(45) Date of Patent: Apr. 21, 2009

(54) METHOD AND APPARATUS FOR DRIVING LIQUID CRYSTAL DISPLAY

(75) Inventor: Seong Ho Baik, Gwachun-shi (KR)

(73) Assignee: LG. Display Co., Ltd., Seoul (KR)

( * ) Notice: Subject to any disclaimer, the term of this patent is extended or adjusted under 35 U.S.C. 154(b) by 1005 days.

(21) Appl. No.: 10/880,321

(22) Filed: Jun. 28, 2004

(65) Prior Publication Data

US 2005/0104827 A1 May 19, 2005

(30) Foreign Application Priority Data

Nov. 13, 2003 (KR) ..... 10-2003-0080177

(51) Int. Cl.
*G09G 3/36* (2006.01)

(52) U.S. Cl. ..... 345/88; 345/89; 345/102; 345/690

(58) Field of Classification Search ..... 345/88–89, 345/102, 690; 348/672
See application file for complete search history.

(56) References Cited

U.S. PATENT DOCUMENTS

| | | | | |
|---|---|---|---|---|
| 5,717,422 | A | 2/1998 | Fergason | |
| 6,795,053 | B1 * | 9/2004 | Funamoto et al. | 345/102 |
| 7,265,743 | B2 * | 9/2007 | Funamoto et al. | 345/102 |
| 2002/0057238 | A1 * | 5/2002 | Nitta et al. | 345/87 |
| 2003/0020974 | A1 * | 1/2003 | Matsushima | 358/521 |
| 2004/0075621 | A1 * | 4/2004 | Shiuan et al. | 345/1.1 |

FOREIGN PATENT DOCUMENTS

| | | |
|---|---|---|
| EP | 1 111 578 | 6/2001 |
| JP | 07-281633 | 10/1995 |
| JP | 2002055664 | 2/2002 |
| KR | 2002-32018 | 5/2002 |
| KR | 2002-73353 | 9/2002 |

OTHER PUBLICATIONS

Office Action dated May 11, 2006 for corresponding Korean Application No. 10-2003-0080177.

* cited by examiner

*Primary Examiner*—Amr Awad
*Assistant Examiner*—Michael Pervan
(74) *Attorney, Agent, or Firm*—Brinks Hofer Gilson & Lione

(57) ABSTRACT

A driving method and apparatus for a liquid crystal display capable of selectively emphasizing a contrast is disclosed. In the apparatus, an image signal modulator partially expands or reduces the contrast of input data to generate output data. The brightness components for one frame are divided into a plurality of areas and an area having a large brightness difference is removed from each area to thereby produce new data. Gray levels of the new data are divided into a plurality of regions of different slopes. The range of output gray levels is enlarged in proportion to the slopes, thereby partially emphasizing the contrast ratio. A timing controller re-arranges the output data to apply it to a data driver.

37 Claims, 11 Drawing Sheets

METHOD AND APPARATUS FOR DRIVING LIQUID CRYSTAL DISPLAY

This application claims the benefit of the Korean Patent Application No. P2003-80177 filed in Korea on Nov. 13, 2003, which is hereby incorporated by reference.

BACKGROUND OF THE INVENTION

1. Field of the Invention

This invention relates to a liquid crystal display, and more particularly to a driving method and apparatus for a liquid crystal display that is capable of selectively emphasizing contrast.

2. Description of the Related Art

Generally, a liquid crystal display (LCD) controls light transmittance of liquid crystal cells in accordance with video signals to thereby display a picture. Such an LCD has been implemented by an active matrix type having a switching device for each cell, and applied to a display device such as a monitor for a computer, office equipments, a cellular phone and the like. The switching device for the active matrix LCD mainly employs a thin film transistor (TFT).

FIG. 1 schematically shows a conventional LCD driving apparatus.

Referring to FIG. 1, the conventional LCD driving apparatus includes a liquid crystal display panel 2 having m×n liquid crystal cells Clc arranged in a matrix type, m data lines D1 to Dm and n gate lines G1 to Gn intersecting each other and thin film transistors TFT provided at the intersections, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals from a system 20, a direct current to direct current converter 14, hereinafter referred to as "DC/DC converter", for generating voltages supplied to the liquid crystal display panel 2 using a voltage from a power supply 12, and an inverter 16 for driving a back light 18.

The system 20 applies vertical/horizontal signals Vsync and Hsync, clock signals DCLK, a data enable signal DE and data R, G and B to the timing controller 10.

The liquid crystal display panel 2 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 8 applies a plurality of gamma voltages to the data driver 4.

The data driver 4 converts digital video data R, G and B into analog gamma voltages (i.e., data signals) corresponding to gray level values in response to a control signal CS from the timing controller 10, and applies the analog gamma voltages to the data lines D1 to Dm.

The gate driver 6 sequentially applies a scanning pulse to the gate lines G1 to Gn in response to a control signal CS from the timing controller 10 to thereby select horizontal lines of the liquid crystal display panel 2 supplied with the data signals.

The timing controller 10 generates the control signals CS for controlling the gate driver 6 and the data driver 4 using the vertical/horizontal synchronizing signals Vsync and Hsync and the clock signal DCLK inputted from the system 20. Herein, the control signal CS for controlling the gate driver 6 is comprised of a gate start pulse GSP, a gate shift clock GSC and a gate output enable signal GOE, etc. Further, the control signal CS for controlling the data driver 4 is comprised of a source start pulse SSP, a source shift clock SSC, a source output enable signal SOE and a polarity signal POL, etc. The timing controller 10 re-aligns the data R, G and B from the system 20 to apply them to the data driver 4.

The DC/DC converter 14 boosts or drops a voltage of 3.3V inputted from the power supply 12 to generate a voltage supplied to the liquid crystal display panel 2. Such a DC/DC converter 14 generates a gamma reference voltage, a gate high voltage VGH, a gate low voltage VGL and a common voltage Vcom.

The inverter 16 applies a driving voltage (or driving current) for driving the back light 18 to the back light 18. The back light 18 generates light corresponding to the driving voltage (or driving current) from the inverter 16 to apply it to the liquid crystal display panel 2.

In order to display a vivid image at the liquid crystal display panel 2 driven in this manner, a distinct contrast between brightness and darkness is made in correspondence with the input data. However, since a method of selectively enlarging the contrast ratio of data in correspondence with the data has not previously existed, it is difficult to display a dynamic and fresh image.

SUMMARY OF THE INVENTION

Accordingly, the present invention provides a driving method and apparatus for a liquid crystal display that is capable of selectively emphasizing the contrast.

A driving apparatus for a liquid crystal display according to one aspect of the present invention includes image signal modulating means for partially expanding or reducing a contrast of an input data to generate an output data; and a timing controller for re-arranging the output data to apply it to a data driver.

The driving apparatus further includes control means for changing a synchronizing signal inputted in synchronization with the input data in such a manner to be synchronized with the output data.

The image signal modulating means includes a brightness/color separator for converting the input data into brightness components and chrominance components; an entire area statistics part for dividing brightness components for one frame into gray levels for each frame to generate an entire histogram; a partial area statistics part for dividing the brightness components for one frame into i areas (wherein i is an integer) and for generating i partial histograms using brightness components at each divided area; an effective selector for comparing partial average values of the partial histograms with an entire average value of the entire histogram to select at least two effective areas of the i areas; a brightness distribution calculator for summing partial histograms at the effective area to generate new histogram; and a data processor for generating modulated brightness components having a partially expanded and reduced contrast using the new histogram.

Herein, the entire histogram, the partial histograms and the new histogram are divided into a plurality of regions each including a desired gray level.

The partial area statistics part includes an area selector for dividing the brightness components for one frame into i areas; and i area statistics parts for generating i partial histograms using brightness components from the area selector.

The effective area selector selects an area at which a partial average value exists within a desired deviation from an entire average value, of the i areas, as an effective area.

The effective area selector includes i comparators for comparing the entire average value with i partial average values; i multiplexers for outputting any one of first control signal and second control signal under control of the comparators; and storage means for temporarily storing outputs of the multiplexers, wherein the comparators control the multiplexers to output the first control signal when the entire average value and the partial average values exist within the desired deviation.

Herein, the brightness distribution calculator sums histograms at areas to which the first control signal corresponds to thereby generate the new histogram.

The driving apparatus further includes a region slope calculator for assigning a slope for each region having new histogram divided into the plurality of regions.

Herein, the region slope calculator assigns the slope proportional to brightness components in which each region is included.

The data processor expands or reduces gray levels of brightness components included in each region proportional to the slope to thereby generate modulated brightness components.

The driving apparatus further includes a brightness/color mixer for generating the output data using the modulated brightness components and the chrominance components.

The driving apparatus further includes delay means for delaying the chrominance components until the modulated brightness components are produced.

The data processor includes a contrast ratio emphasizer for generating the modulated brightness components; and a contrast ratio compensator for applying the modulated brightness components to the brightness/color mixer when an average value of the modulated brightness components generated from the contrast ratio emphasizer and the entire average value exist within a predetermined deviation.

Herein, the contrast ratio compensator subtracts or adds a desired value from or to the modulated brightness components when an average value of the modulated brightness components and the entire average value is not within a predetermined deviation, thereby compensating brightness having the modulated brightness components in such a manner to be analogous to brightness of the entire histogram.

The driving apparatus further includes an inverter controller for controlling brightness of a back light when an average value of the modulated brightness components and the entire average value is not within a predetermined deviation to compensate for brightness having the modulated brightness components.

A method of driving a liquid crystal display according to another aspect of the present invention includes partially expanding or reducing a contrast of an input data to generate an output data; and re-arranging the output data to apply it to a data driver.

The method further includes changing a synchronizing signal inputted in synchronization with the input data to be synchronized with the output data.

The generating the output data includes converting the input data into brightness components and chrominance components; dividing brightness components for one frame into gray levels for each frame to generate an entire histogram for one frame; dividing the brightness components for one frame into i areas (wherein i is an integer) and for generating i partial histograms using brightness components at each divided area; comparing partial average values of the partial histograms with an entire average value of the entire histogram to select at least two effective areas of the i areas; summing partial histograms at the effective area to generate new histogram; and generating modulated brightness components having a partially expanded and reduced contrast using the new histogram.

Herein, the entire histogram, the partial histograms and the new histogram are divided into a plurality of regions each including a desired gray level.

Selecting an effective area includes selecting an area at which a partial average value exists within a desired deviation from an entire average value, of the i areas, as an effective area.

Generating the modulated brightness components includes assigning a slope for each region of the new histogram divided into the plurality of regions; and expanding or reducing gray levels of brightness components included in the region is proportional to the slope.

The slope assigned is proportional to brightness components included in each region.

The method further includes delaying the chrominance components until the modulated brightness components are produced; and generating the output data using the modulated brightness components and the chrominance components.

Generating the modulated brightness components includes subtracting or adding a desired value from or to the modulated brightness components when an average value of the modulated brightness components and the entire average value does not exist within a predetermined deviation, thereby compensating for brightness having the modulated brightness components to be analogous to brightness of the entire histogram.

The method further includes controlling brightness of a back light such that brightness of the modulated brightness components is analogous to brightness of the entire histogram when an average value of the modulated brightness components and the entire average value is not within a predetermined deviation.

BRIEF DESCRIPTION OF THE DRAWINGS

The following detailed description of the embodiments of the present invention will be described with reference to the accompanying drawings, in which.

DETAILED DESCRIPTION OF THE PREFERRED EMBODIMENT

Figure 1:
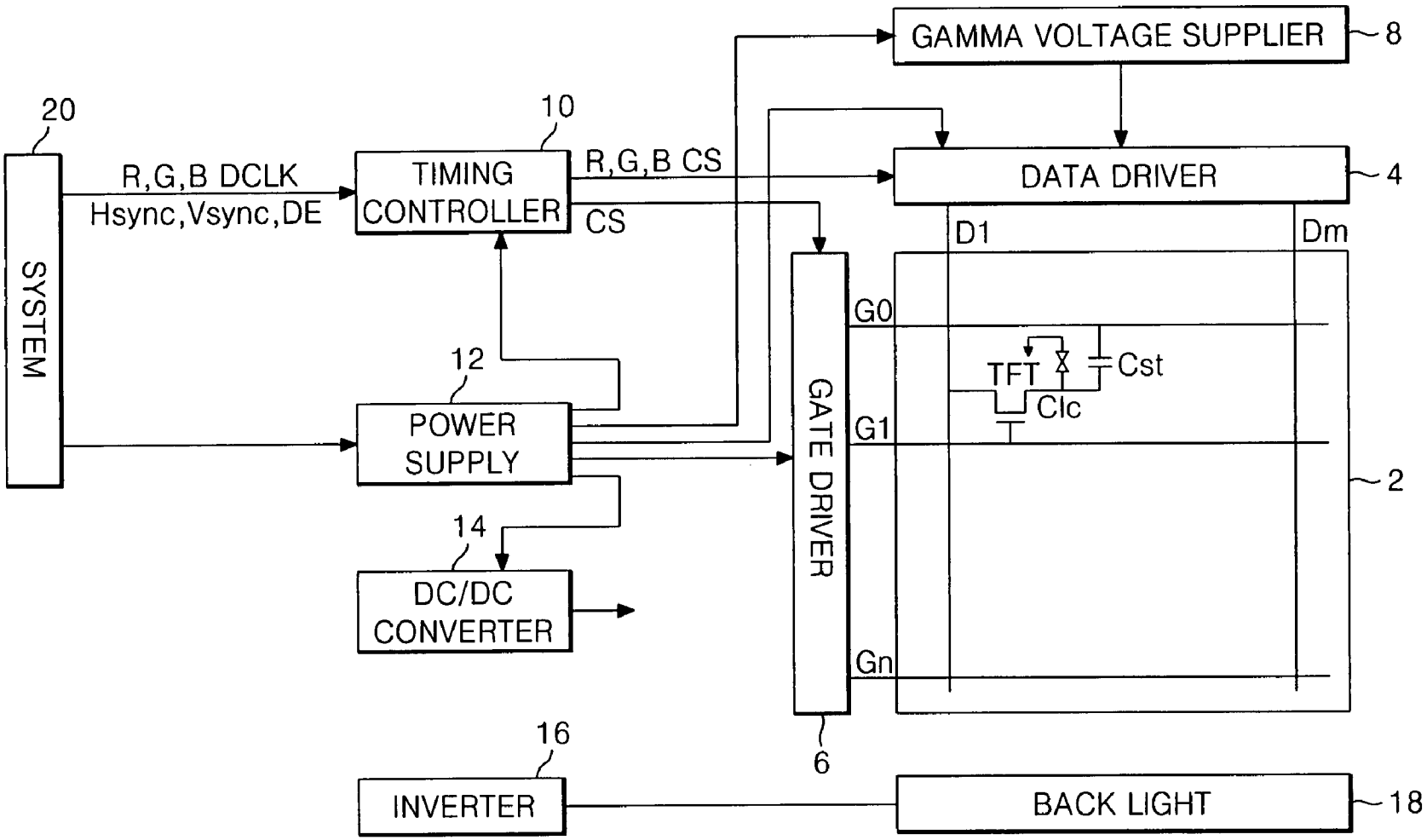
FIG. 1 RELATED ART
FIG. 1 is a schematic block diagram showing a configuration of a conventional driving apparatus for a liquid crystal display.
Figure 2:
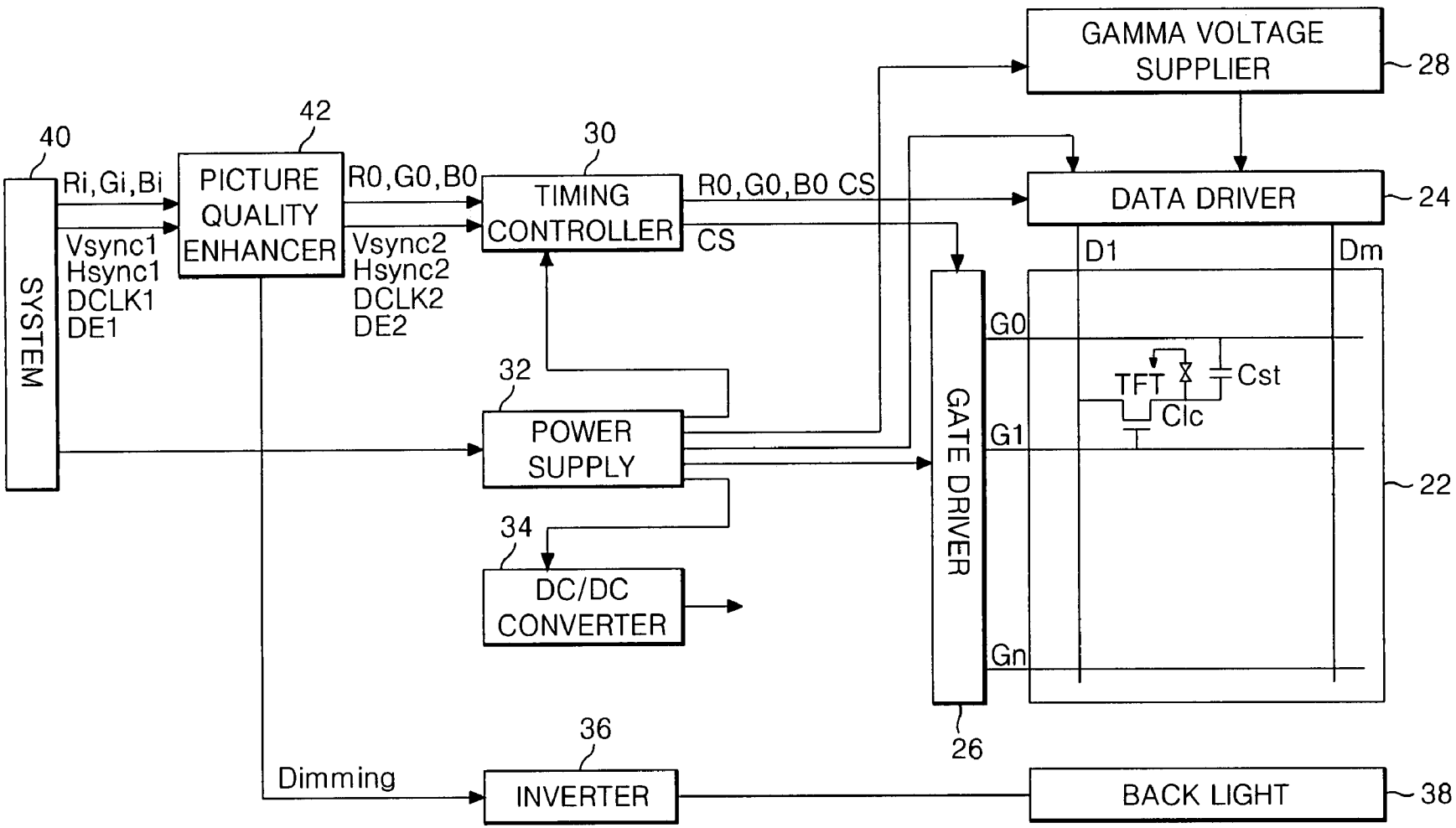
FIG. 2 is a schematic block diagram showing a configuration of a driving apparatus for a liquid crystal display according to an embodiment of the present invention.

FIG. 2 schematically shows a driving apparatus for a liquid crystal display (LCD) according to an embodiment of the present invention.

Referring to FIG. 2, the LCD driving apparatus according to the embodiment of the present invention includes a liquid crystal display panel 22 having m×n liquid crystal cells Clc arranged in a matrix type, m data lines D1 to Dm and n gate lines G1 to Gn intersecting each other and thin film transistors TFT provided at the intersections, a data driver 24 for applying data signals to the data lines D1 to Dm of the liquid crystal display panel 22, a gate driver 26 for applying scanning signals to the gate lines G1 to Gn, a gamma voltage supplier 28 for supplying the data driver 24 with gamma voltages, a timing controller 30 for controlling the data driver 24 and the gate driver 26 using a second synchronizing signal from a picture quality enhancer 42, a DC/DC converter 34 for generating voltages supplied to the liquid crystal display panel 22 using a voltage from a power supply 32, an inverter 36 for driving a back light 38, and a picture quality enhancer 42 for selectively emphasizing a contrast of an input data and for applying a brightness control signal Dimming corresponding to the input data to the inverter 36.

The system 40 applies first vertical/horizontal signals Vsync1 and Hsync1, a first clock signal DCLK1, a first data enable signal DE1 and first data Ri, Gi and Bi to the picture quality enhancer 42.

The liquid crystal display panel 22 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 28 applies a plurality of gamma voltages to the data driver 24.

The data driver 24 converts digital video data R, G and B into analog gamma voltages (i.e., data signals) corresponding to gray level values in response to a control signal CS from the timing controller 30, and applies the analog gamma voltages to the data lines D1 to Dm.

The gate driver 26 sequentially applies a scanning pulse to the gate lines G1 to Gn in response to a control signal CS from the timing controller 30 to thereby select horizontal lines of the liquid crystal display panel 22 supplied with the data signals.

The timing controller 30 generates the control signals CS for controlling the gate driver 26 and the data driver 24 using second vertical/horizontal synchronizing signals Vsync2 and Hsync2 and a second clock signal DCLK2 inputted from the picture quality enhancer 42. Herein, the control signal CS for controlling the gate driver 26 is comprised of a gate start pulse GSP, a gate shift clock GSC and a gate output enable signal GOE, etc. Further, the control signal CS for controlling the data driver 24 is comprised of a source start pulse SSP, a source shift clock SSC, a source output enable signal SOE and a polarity signal POL, etc. The timing controller 30 re-aligns second data Ro, Go and Bo from the picture quality enhancer 42 to apply them to the data driver 24.

The DC/DC converter 34 boosts or drops a voltage of 3.3V inputted from the power supply 32 to generate a voltage supplied to the liquid crystal display panel 22. Such a DC/DC converter 14 generates a gamma reference voltage, a gate high voltage VGH, a gate low voltage VGL and a common voltage VCOM.

The inverter 36 applies a driving voltage (or driving current) corresponding to the brightness control signal Dimming from the picture quality enhancer 42 to the back light 38. In other words, a driving voltage (or driving current) applied from the inverter 36 to the back light 38 is determined by the brightness control signal Dimming from the picture quality enhancer 42. The back light 38 applies light corresponding to the driving voltage (or driving current) from the inverter 36 to the liquid crystal display panel 22.

The picture quality enhancer 42 extracts brightness components using the first data Ri, Gi and Bi from the system 40, and generates second data Ro, Go and Bo obtained by a change in gray level values of the first data Ri, Gi and Bi in correspondence with the extracted brightness components. In this case, the picture quality enhancer 42 generates the second data Ro, Go and Bo such that the contrast is selectively expanded with respect to the input data Ri, Gi and Bi.

Further, the picture quality enhancer 42 generates a brightness control signal Dimming corresponding to brightness components to apply it to the inverter 36. Moreover, the picture quality enhancer 42 generates second vertical/horizontal synchronizing signals Vsync2 and Hsync2, a second clock signal DCLK2 and a second data enable signal DE2 synchronized with the second data Ro, Go and Bo with the aid of the first vertical/horizontal synchronizing signals Vsync1 and Hsync1, the first clock signal DCLK1 and the first data enable signal DE1 inputted from the system 40.

Figure 3:
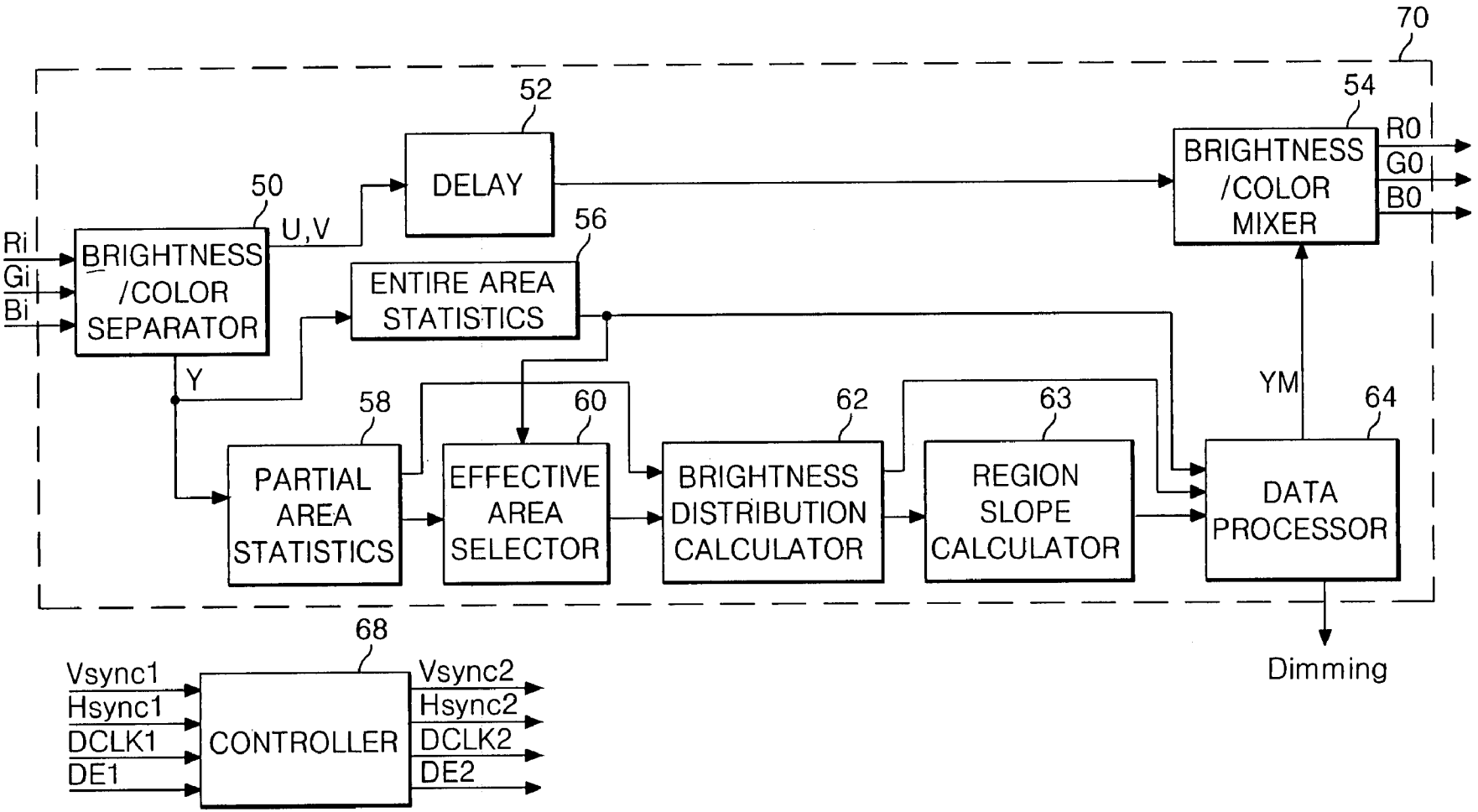
FIG. 3 is a detailed block diagram of the picture quality enhancer shown in FIG. 2.

To this end, as shown in FIG. 3, the picture quality enhancer 42 includes an image signal modulator 70 for generating the second data Ro, Go and Bo using the first data Ri, Gi and Bi and for generating the brightness control signal Dimming, and a control unit 68 for generating the second vertical/horizontal synchronizing signals Vsync2 and Hsync2, the second clock signal DCLK2 and the second enable signal DE2.

The image signal modulator 70 extracts brightness components Y from the first data Ri, Gi and Bi, and generates second data Ro, Go and Bo in which a contrast is partially emphasized with the aid of the extracted brightness components Y. To this end, the image signal modulator 70 includes a brightness/color separator 50, a delay 52, a brightness/color mixer 54, an entire area statistics part 56, a partial area statistics part 58, an effective area selector 60, a brightness distribution calculator 62, a region slope calculator 63 and a data processor 64.

The brightness/color separator 50 separates the first data Ri, Gi and Bi into brightness components Y and chrominance components U and V. Herein, the brightness components Y and the chrominance components U and V are obtained by the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3)$$

Figure 4:
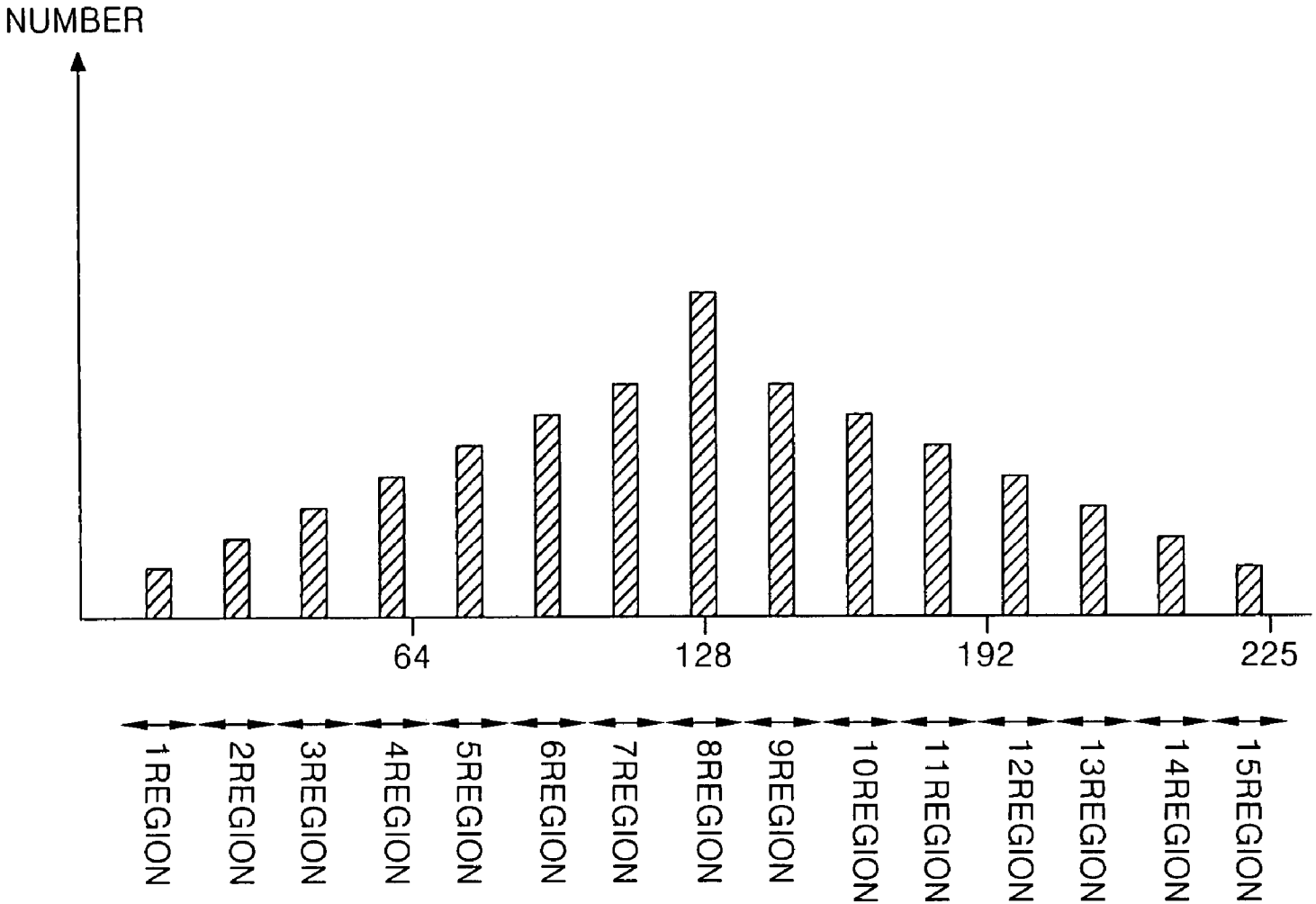
FIG. 4 illustrates a histogram produced by dividing brightness components into a plurality of regions.

The entire area statistics part 56 divides the brightness components Y into gray levels for each frame to produce a histogram. As shown in FIG. 4, the entire area statistics part 56 divides gray levels of the brightness components Y into desired regions and arranges the brightness components Y to correspond to these regions, to thereby produce a histogram. Herein, each region is divided to include desired gray levels (e.g., 1 to 17, 17 to 32, . . . ). In other words, the entire area statistics part 56 arranges the brightness components Y in the first (1) region when the brightness components Y have a gray level '2' while arranging the brightness components Y in the second (2) region when the brightness components Y have a gray level '18'.

Meanwhile, a shape of the histogram shown in FIG. 4 can be set in accordance with brightness components of the first data Ri, Gi and Bi. The entire area statistics part 56 having generated a histogram for one frame applies an average value of the generated histogram to the effective area selector 60.

Figure 5:
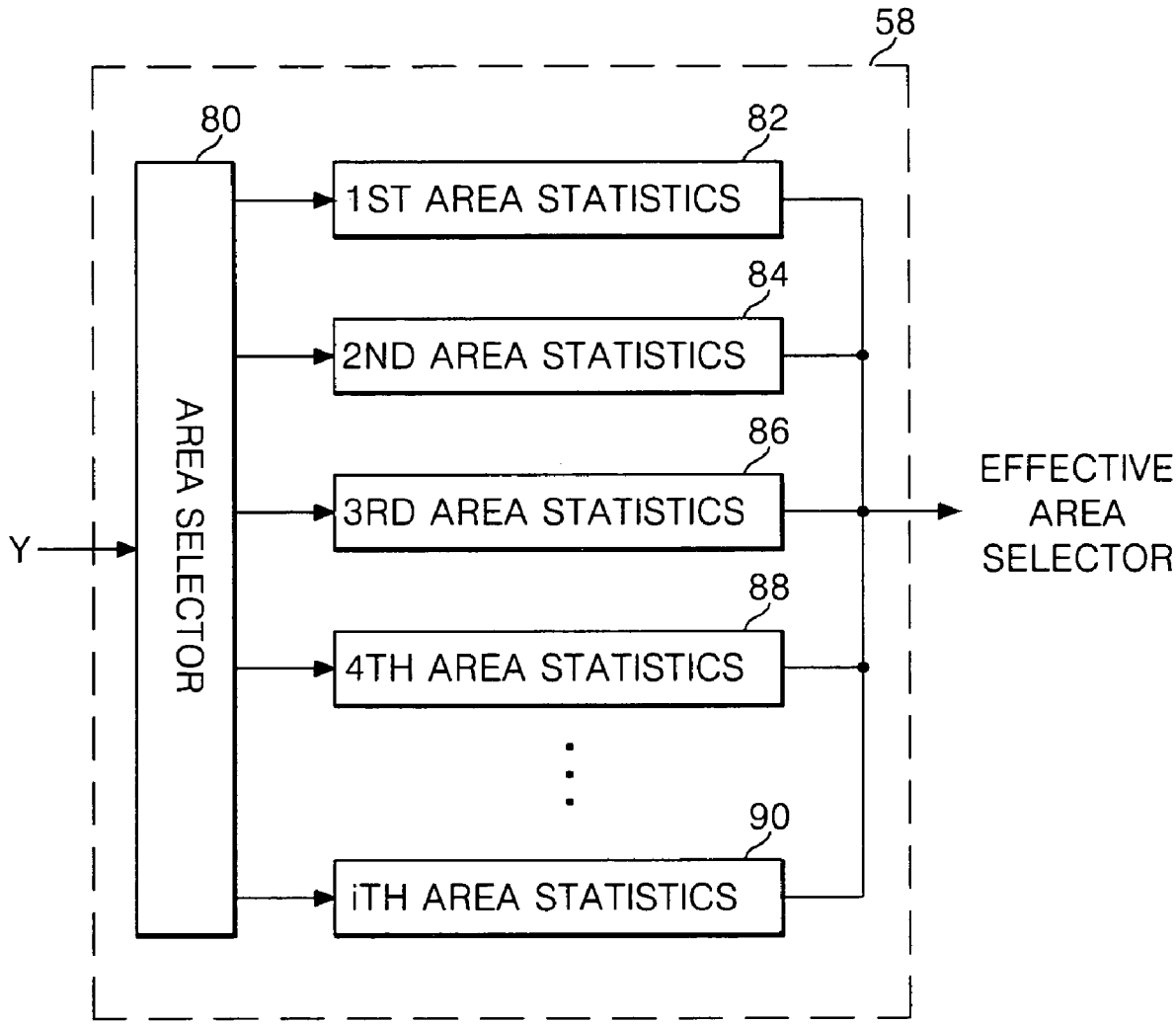
FIG. 5 is a detailed block diagram of the partial area statistics part shown in FIG. 3.

The partial area statistics part 58 divides the brightness components Y for one frame into a plurality of areas in correspondence with a position to be applied to the liquid crystal display panel 22, and generates a histogram using the brightness components Y in the divided areas. To this end, the partial area statistics part 58 includes an area selector 80 and 1st to ith area statistics parts 82 to 90 (wherein i is an integer) as shown in FIG. 5.

Figure 6A:
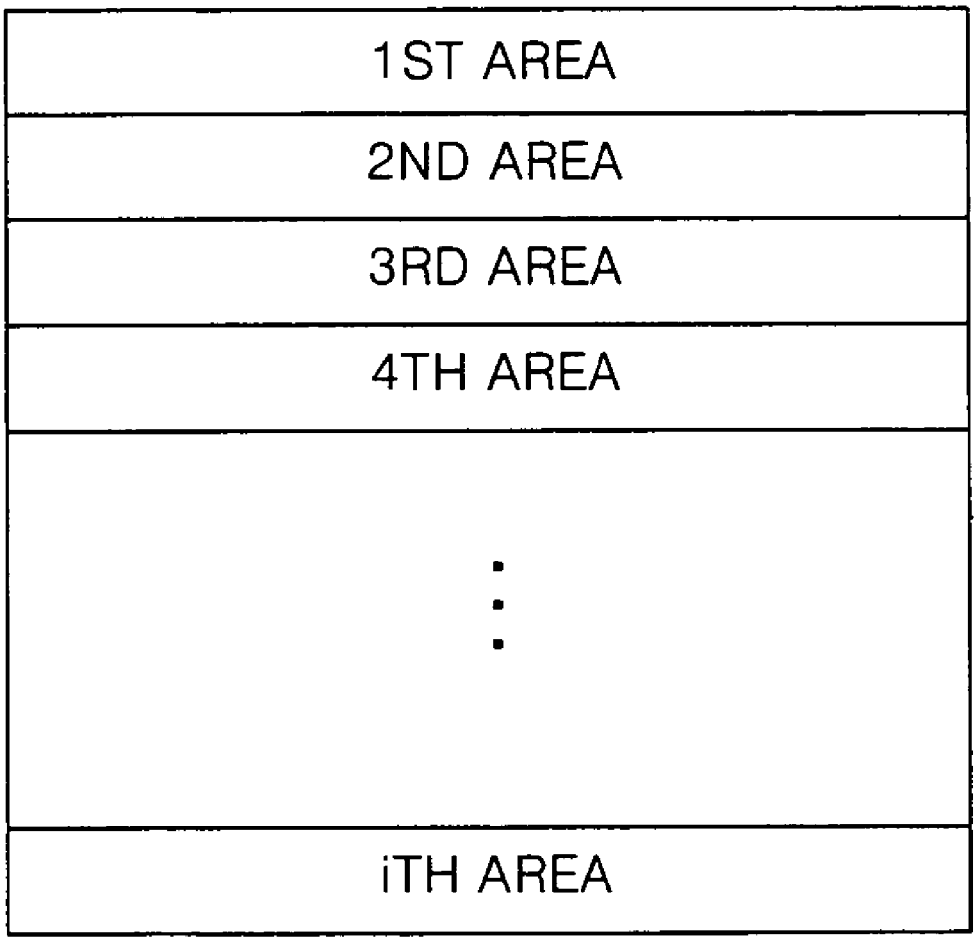
FIG. 6A and FIG. 6B shows examples of selected areas from the area selector shown in FIG. 5.
Figure 6B:
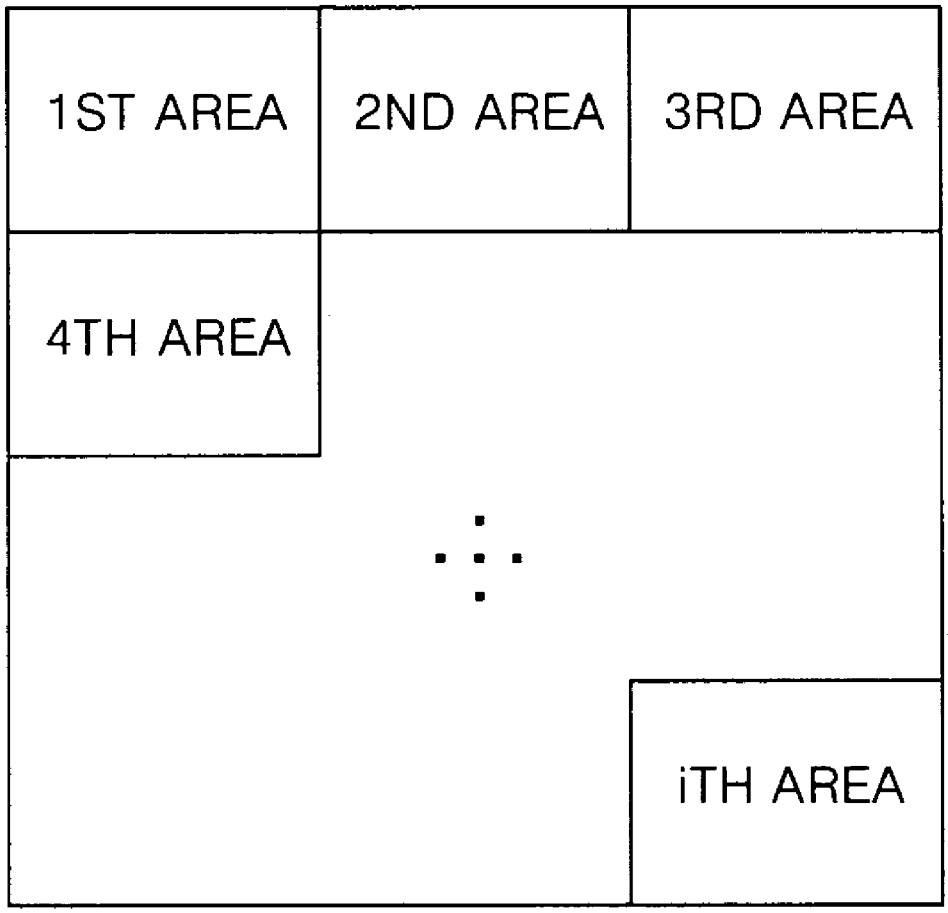

The area selector 80 divides the brightness components Y into a plurality of areas in correspondence with a position to be applied to the liquid crystal display panel 22. For instance, the area selector 80 can divide the area of the liquid crystal display panel 22 for each predetermined horizontal line as shown in FIG. 6A. Alternatively, the area selector 80 can divide the area of the liquid crystal display panel 22 in a specific block shape as shown in FIG. 6B.

The area selector 80 having divided the brightness components Y into a plurality of areas applies brightness components Y corresponding to each area to the 1st to ith area statistics part 82. The first area statistics part 82 produces an area histogram using brightness components Y in the first area applied thereto. In other words, the first area statistics part 82 divides the gray levels into predetermined regions and arranges the brightness components Y in the first area to correspond to the regions, thereby producing a first area histogram. Likewise, the 2nd to ith area statistics parts 84 to 90 produce 2nd to ith area histograms, respectively. The 1st to ith area statistics parts 82 to 90 having produced a histogram corresponding to each area applies an average value of the produced histograms to the effective area selector 60.

The effective area selector 60 compares an entire area average value (i.e., an average value of gray levels) from the entire area statistics part 56 and an area average value (i.e., an average value of gray levels) from the partial area statistics part 58 to select an area to be used for data processing.

More specifically, the effective area selector 60 compares an entire area average value and a first area average value to check whether or not the entire area average value and the first area average value are within a desired deviation. If the entire area average value and the first area average value are within the desired deviation, then the effective area selector 60 outputs a first control signal (e.g., a signal '1') while outputting a second control signal (e.g., a signal '0') if the deviation exceeds the desired deviation. The desired deviation is experimentally determined as it depends upon the length and resolution, for example, of the liquid crystal display panel.

Likewise, the effective area selector 60 outputs the first or second control signal while checking whether or not the entire area average value and each area average value (i.e., a 2n area average value, a 3rd area average value, . . . , a ith area average value) are within the desired deviation.

Figure 7:
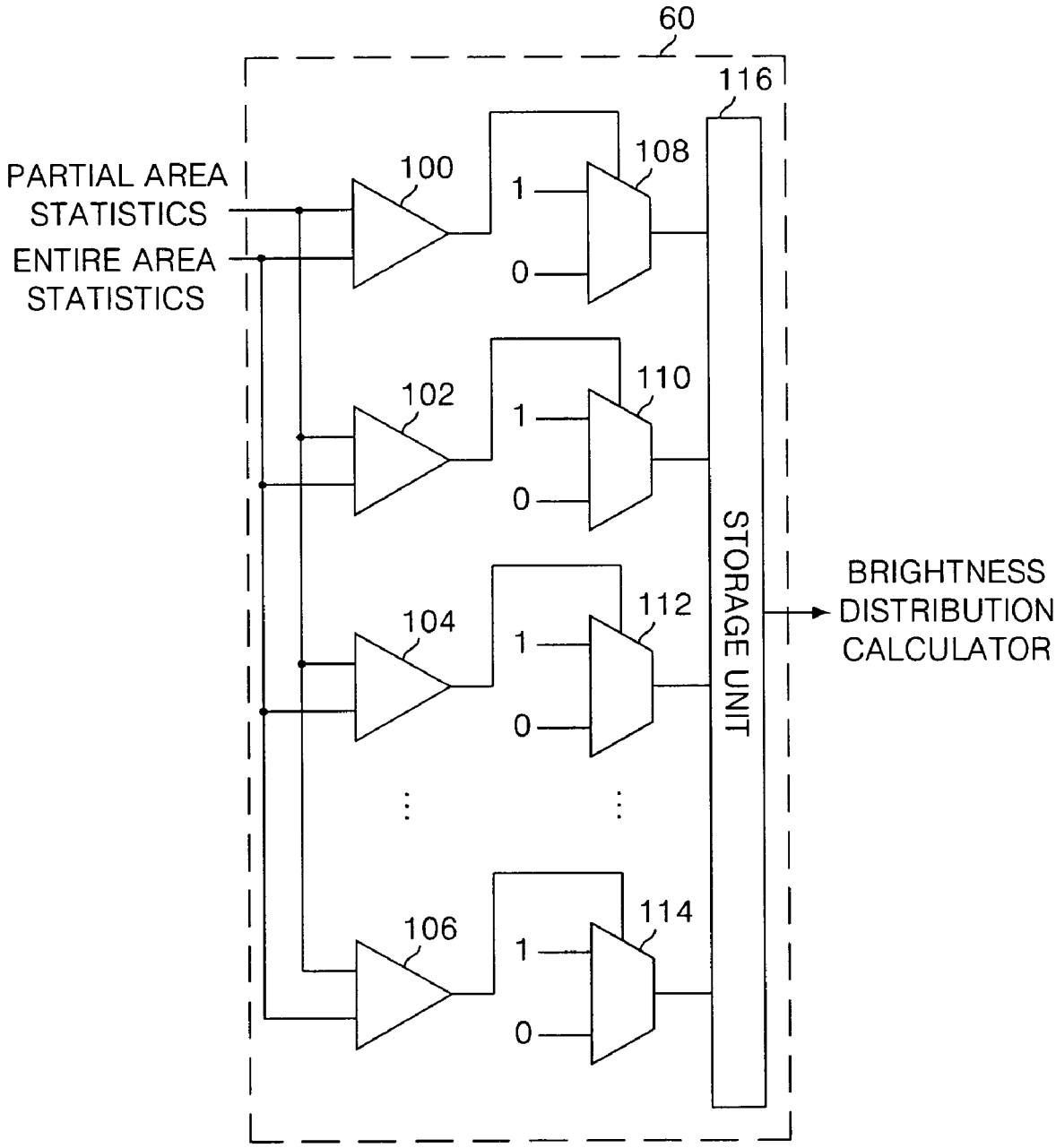
FIG. 7 is a detailed block diagram of the effective area selector shown in FIG. 3.

To this end, the effective area selector 60 includes i comparators 100 to 106, i multiplexers 108 to 114 and a storage unit 116 as shown in FIG. 7.

The i comparators 100 to 106 check whether or not the entire area average value and each area average value exist within a desired deviation, and control the multiplexers 108 to 114 in response to the check result. The comparators 100 to 106 control the multiplexers 108 to 114 such that the first control signal is outputted from the multiplexers 108 to 114 when the entire area average value and each area average value exist within the desired deviation, whereas they control the multiplexers 108 to 114 such that the second control signal is outputted from the multiplexers 108 to 114 in the other case. The storage unit 116 temporarily stores control signals outputted from the multiplexers 108 to 114 and applies the stored control signals to the brightness distribution calculator 62.

The brightness distribution calculator 62 receives i area histograms from the partial area statistics part 58, and receives the first control signal or the second control signal from the effective area selector 60. Then, the brightness distribution calculator 62 sums only the area histogram corresponding to the ith control signal to generate a new histogram. In other words, the brightness distribution calculator 62 excludes area histograms corresponding to the second control signal (i.e., areas in which the entire area average value and the area average value are not within the desired deviation) when it generates the new histogram.

In other words, the present embodiment excludes areas in which the difference between the entire area average value and the area average value is beyond the desired deviation to thereby produce the new histogram. Thus, the contrast ratio of the data is expanded using the newly produced histogram, and a sharp and vivid picture is displayed on the liquid crystal display panel 22 under control of the inverter 36.

More specifically, the contrast ratio of the data is expanded using the entire area histogram produced from the entire area statistics part 56 and control of the inverter 36. However, if the brightness is controlled using the entire area histogram alone, then certain images become cloudy when displayed. For instance, if an image of the moon against a dark sky is displayed, the brightness of such a frame should be entirely dark. However, the entire average value is raised by the moon in the entire area histogram, and thus the brightness is entirely bright. Accordingly, the present embodiment removes the area corresponding to the moon from the frame to produce the new histogram, thereby controlling the brightness of the entire frame and permitting the brightness to be dark.

The region slope calculator 63 calculates a slope to be applied to each region using the histogram produced from the brightness distribution calculator 62. For instance, a procedure of calculating a slope will be described in detail assuming that a histogram as shown in FIG. 4 has been calculated.

Figure 8:
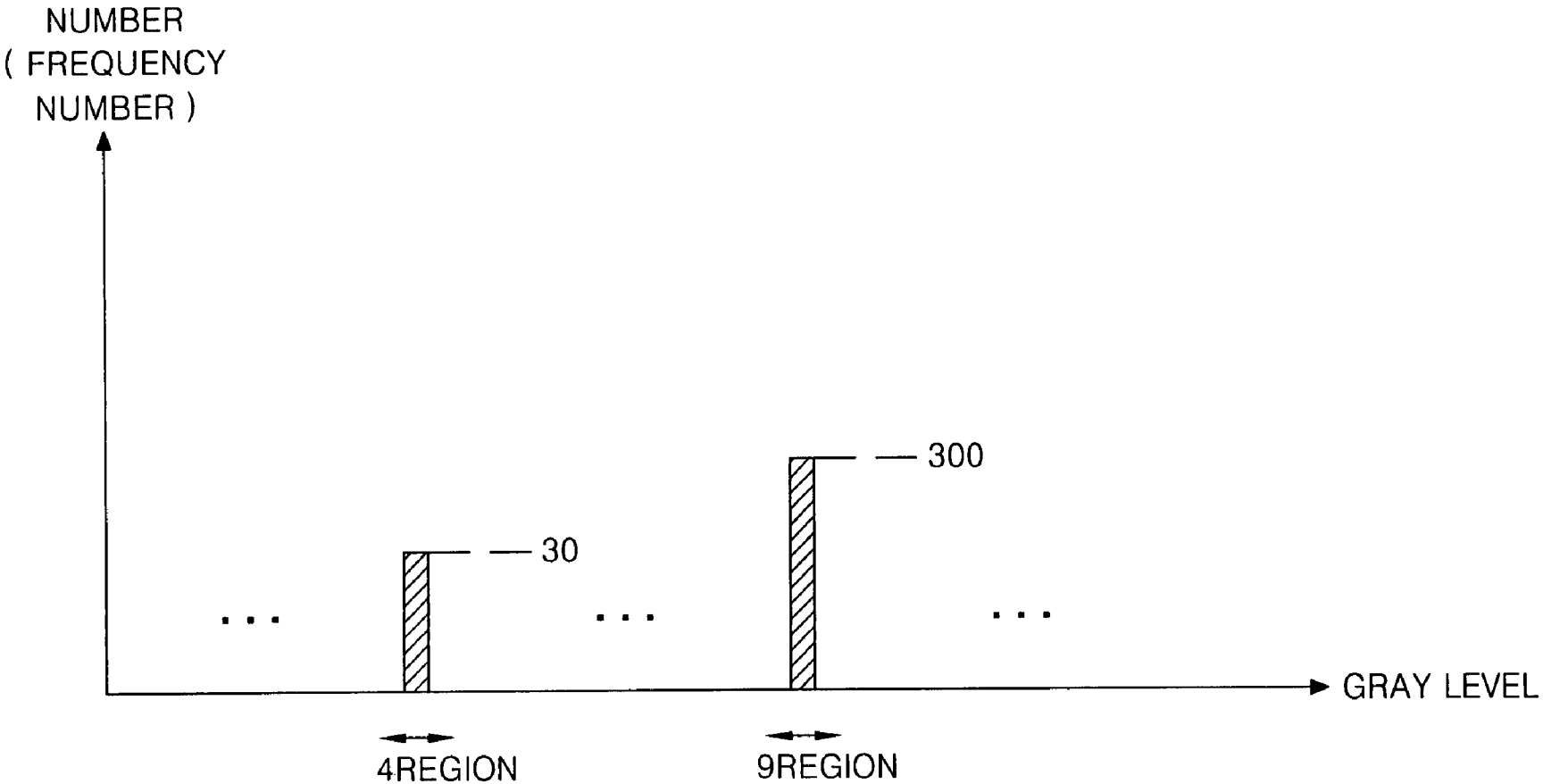
FIG. 8 is a graph showing the frequency number of gray levels included in each region of the histogram.

Firstly, the slope is determined by the ratio of Y-axis variations to X-axis variations. In FIG. 4, since the X-axis is divided into 15 regions, the X-axis variations are fixed to 1/15. The Y-axis variations are determined by the frequency number of gray levels included in each region. For instance, if total frequency number of the brightness components Y is '1000' and the frequency number in the fourth (4) region is '30' in the histogram calculated by the brightness distribution calculator 62, then the Y-axis variations becomes 30/1000 as shown in FIG. 8. Thus, the slope in the fourth region is set to (30/1000)/(1/15)=0.45. Likewise, the slope in the eighth (8) region in which the frequency number is 300 is set to (300/1000)/(1/15)=4.5.

In other words, the region slope calculator 63 calculates the slope in proportion to the brightness components Y included in each histogram region. A high slope is calculated in a region having large brightness components Y, whereas a low slope is calculated in a region having small brightness components Y.

Figure 9:
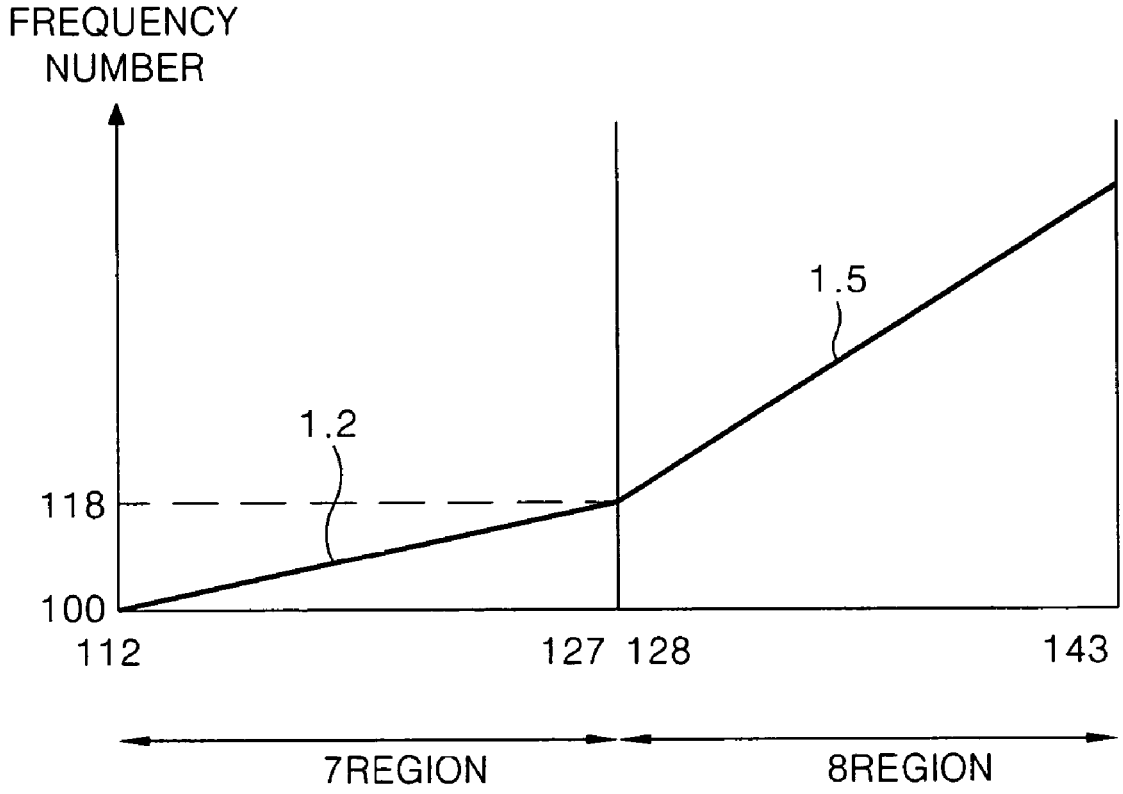
FIG. 9 is a graph showing a slope of the calculated histogram region from the region slope calculator.
Figure 10:
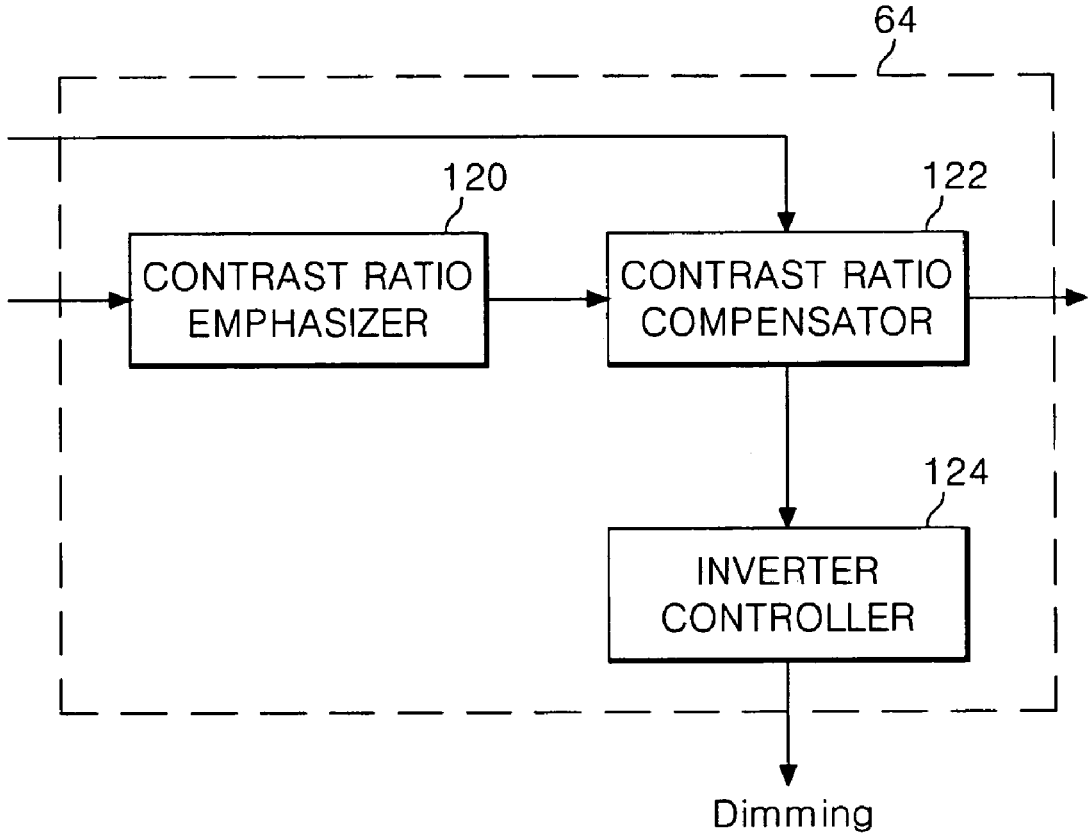
FIG. 10 is a detailed block diagram of the data processor shown in FIG. 3.

After the slope is calculated in each region, the region slope calculator 62 calculates an offset representing the start frequency number of each region. For instance, if a slope of 1.2 has been calculated in the seventh (7) region and a slope of 1.5 has been calculated in the eighth (8) region as shown in FIG. 9, then the offset is determined by the quantity: the offset in the immediately previous region+the maximum value in the immediately previous region. In other words, the offset in the eighth region is set to 118 because the offset in the seventh region is 100 and the maximum value in the seventh region is 1.2 (the slope in the seventh region)×15 (entire region). The region slope calculator 63 calculates the slope of each histogram and obtains an offset in which each region represents the start frequency number.

The slope and the offset obtained by the region slope calculator 63 are applied to the data processor 64. The data processor 64 generates modulated brightness components YM using the slope and the offset applied thereto. To this end, the data processor 64 includes a contrast ratio emphasizer 120, a contrast ratio compensator 122 and inverter controller 124.

The contrast emphasizer 120 receives the slope and the offset from the region slope calculator 63 and generates an output gray level corresponding to an input gray level using the following equation:

$$\text{Output gray level (Modulated brightness components)} = \text{Slope} \times \{\text{Input gray level} - \text{Region of input gray level}\} + \text{Offset} \quad (4)$$

In the above equation (4), "Input gray level" represents the gray levels of the input brightness components Y, and "Region of input gray level" represents the value obtained by multiplying a region of the input gray level by the total region size and subtracting one (1) from the multiplied value. Further, "Slope" represents the slope in the region to which the input gray level belongs, and "Offset" is an offset in the region to which the input gray level belongs.

For instance, if the slope and the offset have been set as shown in FIG. 9 and a gray level of 130 is inputted as the brightness components, then the output gray level becomes $YM=1.5\times\{130-(8\times15-1)\}+118\approx135$. In this manner, the contrast ratio emphasizer 120 modulates the brightness components Y to generate the output gray level. Since the output gray level is generated in proportion to the slope, the gray level in a region having a large brightness component is widely diffused, and thus the contrast ratio is selectively emphasized. To the contrary, the gray level is reduced in a region having a small slope. The contrast ratio emphasizer 120 generates a new histogram using the output gray level generated by the above equation (4).

The contrast compensator 122 receives the entire area average value from the entire area statistics part 56 and receives the average value of the new histogram from the brightness distribution calculator 62. The contrast compensator 122 having received the entire area average value and the average value of the new histogram subtracts the average value of new histogram from the entire area average value. The contrast ratio compensator 122 determines whether or not the subtracted value exists within a predetermined deviation, and, if not, then compensates the output gray level to apply it to the brightness/color mixer 54.

If a large difference exists between the entire area average value and the average value of new histogram, then the new image has a brightness that is irrespective of the original image. Accordingly, whether or not the value obtained by subtracting the average value of the new histogram from the entire area average value exists within the predetermined deviation, the contrast ratio compensator 122 prevents generation of a large brightness difference. The predetermined deviation is experimentally set to a value in which a large brightness difference is not generated in accordance with the length and resolution, etc. of the liquid crystal display panel 22.

When the value obtained by subtracting the average value of the new histogram from the entire area average value exists within the predetermined deviation, the contrast ratio compensator 122 applies an output gray level (i.e., new histogram) from the contrast ratio emphasizer 120, as modulated brightness components YM to the brightness/color mixer 54. On the other hand, when the value obtained by subtracting the average value of the new histogram from the entire area average value does not exist within the predetermined deviation, the contrast ratio compensator 122 adds the predetermined value to the output gray level (i.e., new histogram) or subtracts the predetermined value from the output gray level to thereby compensate for the contrast ratio. Thus, the contrast ratio compensator 122 subtracts the predetermined value when the average value of the new histogram is high, and adds the predetermined value in the other cases.

Similarly, the inverter controller 124 also controls the inverter 36 when the value obtained by subtracting the average value of the new histogram from the entire area average value does not exist within the predetermined deviation to thereby compensate for the contrast ratio. Herein, the inverter controller 124 controls the inverter 36 such that light having a low brightness can be applied when the average value of the new histogram is high, and controls the inverter 36 such that light having a high brightness can be applied in the other cases.

The delay 52 delays chrominance components U and V until the brightness components YM modulated by the data processor 58 are produced. Then, the delay 52 applies the delayed chrominance components UD and VD synchronized with the modulated brightness components YM to the brightness/color mixer 54.

The brightness/color mixer 54 generates second data Ro, Go and Bo with the aid of the modulated brightness components YM and the delayed chrominance components UD and VD. Herein, the second data Ro, Go and Bo is obtained by the following equations:

$$Ro = YM + 0.000 \times UD + 1.140 \times VD \quad (5)$$

$$Go = YM - 0.396 \times UD - 0.581 \times VD \quad (6)$$

$$Bo = YM + 2.029 \times UD + 0.000 \times VD \quad (7)$$

Since the second data Ro, Go and Bo obtained by the brightness/color mixer 54 has been produced from the modulated brightness components YM having a selectively emphasized contrast ratio, they have more selectively emphasized contrast ratio than the first data Ri, Gi and Bi.

The control unit 68 receives the first vertical/horizontal synchronizing signals Vsync1 and Hsync1, the first clock signal DCLK1 and the first data enable signal DE1 from the system 40. Further, the controller 68 generates the second vertical/horizontal synchronizing signals Vsync2 and Hsync2, the second clock signal DCLK2 and the second data enable signal DE2 in such a manner to be synchronized with the second data Ro, Go and Bo, and applies them to the timing controller 30.

As described above, according to the present invention, brightness components for one frame are divided into a plurality of areas and areas having large brightness differences are removed to thereby produce a new histogram and produce new data using the new histogram. If data is generated with the aid of the new histogram, then it becomes possible to prevent brightness in a partial area largely higher or lower than other areas from affecting the entire brightness. Furthermore, according to the present invention, gray levels of the new histogram are divided into a plurality of regions, and a high slope is assigned when a large number of gray levels are included in the regions while a low slope is assigned when a small number of gray levels are included in the regions. Moreover, a range of the output gray level is enlarged in proportion to the slope, thereby partially emphasizing the contrast ratio and thus displaying a vivid image.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a liquid crystal display, comprising:

image signal modulating means for partially expanding or reducing contrast of input data to generate output data; and a timing controller for re-arranging the output data to apply the output data to a data driver;

wherein the image signal modulating means includes:

a brightness/color separator for converting the input data into brightness components and chrominance components;

an entire area statistics part for dividing the brightness components for one frame into gray levels of the frame to generate an entire histogram;

a partial area statistics part for dividing the brightness components one of the frame into i areas (wherein i is an integer) and for generating i partial histograms using brightness components in each divided area;

an effective selector for comparing partial average values of the partial histograms with an entire average value of the entire histogram to select at least two effective areas of the i areas;

a brightness distribution calculator for summing partial histograms in the effective area to generate a new histogram; and a data processor for generating modulated brightness components having a partially expanded and reduced contrast using the new histogram.

2. The driving apparatus of claim 1, further comprising control means for changing a synchronizing signal inputted in synchronization with the input data to be synchronized with the output data.

3. The driving apparatus of claim 1, wherein the entire histogram, the partial histograms and the new histogram are divided into a plurality of regions each including a desired gray level.

4. The driving apparatus of claim 1, wherein the partial area statistics part includes:

an area selector for dividing the brightness components one of the frame into areas; and i area statistics parts for generating i partial histograms using the brightness components from the area selector.

5. The driving apparatus of claim 3, wherein the effective area selector selects an area of the i areas in which the partial average value exists within a desired deviation from the entire average value as an effective area.

6. The driving apparatus of claim 5, wherein the effective area selector includes:

i comparators for comparing the entire average value with i partial average values;

i multiplexers for outputting a first control signal or a second control signal under control of the comparators; and storage means for temporarily storing outputs of the multiplexers, wherein the comparators control the multiplexers to output the first control signal when the entire average value and the partial average values exist within the desired deviation.

7. The driving apparatus of claim 6, wherein the brightness distribution calculator sums histograms in areas to which the first control signal corresponds to thereby generate the new histogram.

8. The driving apparatus of claim 7, further comprising a region slope calculator for assigning a slope for each region having a new histogram divided into the plurality of regions.

9. The driving apparatus of claim 8, wherein the region slope calculator assigns the slope to be in proportion to brightness components in which each region is included.

10. The driving apparatus of claim 9, wherein the data processor expands or reduces the gray levels of the brightness components included in each region to be in proportion to the slope to thereby generate modulated brightness components.

11. The driving apparatus of claim 10, further comprising a brightness/color mixer for generating the output data using the modulated brightness components and the chrominance components.

12. The driving apparatus of claim 11, further comprising delay means for delaying the chrominance components until the modulated brightness components are produced.

13. The driving apparatus of claim 11, wherein the data processor includes:

a contrast ratio emphasizer for generating the modulated brightness components; and a contrast ratio compensator for applying the modulated brightness components to the brightness/color mixer when an average value of the modulated brightness components generated from the contrast ratio emphasizer and the entire average value exist within a predetermined deviation.

14. The driving apparatus of claim 13, wherein the contrast ratio compensator subtracts or adds a desired value from or to the modulated brightness components when an average value of the modulated brightness components and the entire average value does not exist within the predetermined deviation, thereby compensating brightness having the modulated brightness components to be analogous to brightness of the entire histogram.

15. The driving apparatus of claim 13, further comprising an inverter controller for controlling brightness of a back light when an average value of the modulated brightness components and the entire average value are not within the predetermined deviation to compensate for brightness having the modulated brightness components.

16. A method of driving a liquid crystal display, the method comprising:

partially expanding or reducing contrast of input data to generate output data; and re-arranging the output data to apply the output data to a data driver;

wherein generating the output data includes:

converting the input data into brightness components and chrominance components;

dividing brightness components for one frame into gray levels to generate an entire histogram;

dividing the brightness components into i areas (wherein i is an integer) and generating i partial histograms using the brightness components in each divided area;

comparing partial average values of the partial histograms with an entire average value of the entire histogram to select at least two effective areas of the i areas;

summing the partial histograms in each effective area to generate a new histogram; and generating modulated brightness components having a partially expanded and reduced contrast using the new histogram.

17. The method of claim 16, further comprising changing a synchronizing signal inputted in synchronization with the input data to be synchronized with the output data.

18. The method of claim 16, wherein the entire histogram, the partial histograms and the new histogram are divided into a plurality of regions each including a desired gray level.

19. The method of claim 18, further comprising selecting an area in which the partial average value is within a desired deviation from the entire average value as one of the effective areas.

20. The method of claim 19, wherein generating the modulated brightness components comprises:

assigning a slope for each region of the new histogram divided into the plurality of regions; and expanding or reducing gray levels of the brightness components of each region to be in proportion to the slope in the region.

21. The method of claim 20, wherein the slope of each region is proportional to the brightness components of the region.

22. The method of claim 20, further comprising:

delaying the chrominance components until the modulated brightness components are produced; and generating the output data using the modulated brightness components and the chrominance components.

23. The method of claim 20, wherein generating the modulated brightness components further comprises subtracting or adding a desired value from or to the modulated brightness components when an average value of the modulated brightness components and the entire average value are not within a predetermined deviation, thereby compensating for brightness having the modulated brightness components analogous to brightness of the entire histogram.

24. The method of claim 20, further comprising controlling brightness of a back light such that brightness of the modulated brightness components is analogous to brightness of the entire histogram when an average value of the modulated brightness components and the entire average value are not within a desired deviation.

25. A method of driving a liquid crystal display, the method comprising:

separating an entire area of the liquid crystal display into a plurality of individual areas;

extracting brightness components of one frame from input data to be supplied to the liquid crystal display for the entire area and for the individual areas;

determining an average of the brightness components in the entire area and averages of the brightness components in the individual areas;

comparing the average values of the individual areas with the average value of the entire area;

modifying the brightness components of the individual areas differently dependent on whether or not the averages of the brightness components in the individual areas are within a predetermined deviation from the average of the brightness components in the entire area to produce modulated brightness components;

generating output data using the modulated brightness components instead of the brightness components; and supplying the output data to the liquid crystal display.

26. The method of claim 25, further comprising eliminating, from generating the output data, the brightness components of the individual areas in which the averages of the brightness components are not within the predetermined deviation from the average of the brightness components in the entire area.

27. The method of claim 25, further comprising reducing contrast in the frame using the modulated brightness components from the contrast in the frame that would be displayed using the brightness components.

28. The method of claim 25, further comprising extracting chrominance components from the input data along with the brightness components.

29. The method of claim 28, further comprising delaying the chrominance components until the modulated brightness components are produced.

30. The method of claim 29, further comprising generating the output data using the chrominance components.

31. The method of claim 25, further comprising adjusting the modulated brightness components by a desired value when an average value of the modulated brightness components and the average value of the entire area are not within a predetermined deviation prior to generating the output data from the modulated brightness components.

32. The method of claim 31, further comprising adding or subtracting a predetermined value to the modulated brightness components to compensate for brightness having the modulated brightness components analogous to brightness of the entire area.

33. The method of claim 25, further comprising controlling brightness of a back light such that brightness of the modulated brightness components is analogous to brightness of the entire area when an average value of the modulated brightness components and the average value of the entire area are not within a predetermined deviation.

34. The method of claim 25, further comprising creating histograms of the brightness components and the modulated brightness components to aid in modification of the brightness components and the modulated brightness components.

35. The method of claim 25, further comprising generating an output gray level related to an input gray level such that brightness of the input gray level is diffused proportional to the brightness of the input gray level.

36. The method of claim 25, further comprising decreasing contrast differences in the frame by using the modulated brightness components.

37. The method of claim 25, further comprising generating histograms of the brightness components and statistically adjusting the histograms during generation of the modulated brightness components.

* * * * *

UNITED STATES PATENT AND TRADEMARK OFFICE

CERTIFICATE OF CORRECTION

PATENT NO. : 7,522,135 B2
APPLICATION NO. : 10/880321
DATED : April 21, 2009
INVENTOR(S) : Seong Ho Baik It is certified that error appears in the above-identified patent and that said Letters Patent is hereby corrected as shown below:

In column 12, claim 4, line 12, after "of the frame into" insert --i--.

Signed and Sealed this

Fifteenth Day of September, 2009

David J. Kappos

David J. Kappos
*Director of the United States Patent and Trademark Office*